US007121166B2

(12) United States Patent
Drzewiecki

(10) Patent No.: US 7,121,166 B2
(45) Date of Patent: Oct. 17, 2006

(54) POWER TONG ASSEMBLY

(75) Inventor: Lopek Drzewiecki, Edmonton (CA)

(73) Assignee: National-Oilwell, L.P., Houston, TX (US)

( * ) Notice: Subject to any disclaimer, the term of this patent is extended or adjusted under 35 U.S.C. 154(b) by 210 days.

(21) Appl. No.: 10/835,610

(22) Filed: Apr. 29, 2004

(65) Prior Publication Data

US 2005/0241441 A1 Nov. 3, 2005

(51) Int. Cl.
*B25B 13/50* (2006.01)

(52) U.S. Cl. ..... 81/57.33; 81/57.16; 81/57.19; 81/57.34

(58) Field of Classification Search ..... 81/57.33, 81/57.34, 57.36, 57.15, 57.16, 57.2, 57.19
See application file for complete search history.

(56) References Cited

U.S. PATENT DOCUMENTS 2,453,369 A 11/1948 Grable
4,082,017 A * 4/1978 Eckel ..... 81/57.16
4,574,664 A * 3/1986 Curry ..... 81/57.34
4,712,284 A * 12/1987 Coyle et al. ..... 29/240
5,161,438 A 11/1992 Pietras
5,167,173 A * 12/1992 Pietras ..... 81/57.15
5,702,139 A 12/1997 Buck
6,070,500 A 6/2000 Diask et al.
6,116,118 A 9/2000 Wesch, Jr.
6,138,529 A 10/2000 Pietras
6,263,763 B1 * 7/2001 Feigel et al. ..... 81/57.34

FOREIGN PATENT DOCUMENTS

WO WO 07/74899 12/2000

OTHER PUBLICATIONS

European Patent Office Partial Search Report; Appln. No. 05252607.6 dated Nov. 17, 2005; (pp. 6.
European Patent Office Partial Search Report; Appln. No. 05252607.62315 dated Aug. 16, 2005; (pp. 5).

* cited by examiner

*Primary Examiner*—Hadi Shakeri
(74) *Attorney, Agent, or Firm*—Conley Rose, P.C.

(57) ABSTRACT

A tong assembly comprises a body and a center member slidable relative to the body. A pair of clamping arms is rotatably connected to the body. The clamping arms are connected to the center member such that as the center member slides relative to said body, the clamping arms rotate relative to the body. The assembly also comprises a plurality of die assemblies, wherein at least one die assembly is mounted to each clamping arm and at least one die assembly is mounted to the center member.

6 Claims, 4 Drawing Sheets

POWER TONG ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

The present invention relates generally to methods and apparatus for gripping and manipulating pipe. More particularly, the present invention relates to methods and apparatus for facilitating the connection and disconnection of sections of drill pipe.

Drill strings used in rotary drilling are often constructed from individual lengths of drill pipe connected in series to form a drillstring. The individual lengths of drill pipe are commonly joined by threaded connections. Because of the loads incurred by the drillstring, the connections have to be pre-loaded with a certain amount of torque in order to maintain a satisfactory connection during use.

Pipe tongs are one tool used for facilitating the connection and disconnection, or making and breaking, of drill pipe connections. Pipe tongs are generally located at the drill floor and operate by gripping a connection between two adjacent lengths of pipe and applying torque to loosen or tighten the connection. Many pipe tongs operate by gripping above and below the junction between two adjacent pipe sections. The tongs then rotate the two sections of pipe relative to each other. This rotation often has a very limited rotational range but is performed with sufficient torque to properly make or break the connection. The torque applied to a given connection can be on the order of tens of thousands of foot-pounds.

Because of the high torque loads applied to the pipe, pipe tongs have been known to scar the outer diameter of the pipe, especially if the pipe slips within the tong. In order to minimize this slippage, as well as to ensure the proper torque requirements are met, the interface between the pipe and the tong is critical. In some cases, pipe tongs have been known to partially collapse the pipe with an excessive clamping force. Excessive damage to the pipe is often a result of the pipe not being centered within the pipe tong causing the gripping mechanism of the tong to apply uneven force to the pipe.

Thus, there remains a need to develop methods and apparatus for facilitating the connection and disconnection of pipe sections, which overcome some of the foregoing difficulties while providing more advantageous overall results.

SUMMARY OF THE PREFERRED EMBODIMENTS

A tong assembly comprising a body and a center member slidable relative to said body. A pair of clamping arms are rotatably connected to said body. The clamping arms are connected to said center member such that as said center member slides relative to said body, said clamping arms rotate relative to said body. The assembly also comprises a plurality of die assemblies, wherein at least one die assembly is mounted to each clamping arm and at least one die assembly is mounted to said center slider.

One embodiment comprises a tong assembly comprising a body and a center member slidable relative to said body. A pair of clamping arms are rotatably connected to said body. The clamping arms are connected to said center member such that as said center member slides relative to said body, said clamping arms rotate relative to said body. The assembly includes a plurality of die assemblies, wherein at least one die assembly is mounted to each clamping arm and at least one die assembly is mounted to said center slider. In some embodiments, a hydraulic cylinder is operable to slide said center member relative to said body.

In certain embodiments, the die assemblies that are mounted to the clamping arms are rotatable relative to the clamping arms and the die assembly that is mounted to the center slider is not rotatable relative to the center slider. Each die assembly may comprise a die, a holder adapted to receive the die; and a retainer supporting the holder such that the holder is rotatable relative to the retainer, wherein the retainer is attached to one of the clamping arms.

The tong assembly may also comprises a pair of connecting links, wherein each of the connecting links is pivotally connected to the center member and one of the clamping arms by a pin connection that connects to one of the connecting links; and a pivot connection that connects to the body, wherein the clamping arm rotates about the pivot connection, wherein the distance from the pin connection to the pivot connection is equal to the distance from the pivot connection to the center of the die assembly. In some embodiments, the body is a unitary weldment having an open side and the center member and the clamping arms are installed in the body through the open side.

In another embodiment, the tong assembly may comprise an upper tong, a back-up tong aligned with and below the upper tong, a slider connected between the upper tong and the back-up tong, wherein the slider establishes a center point about which the upper tong and the back-up tong can rotate. A pair of first hydraulic cylinders operable to rotate the upper tong relative to the back-up tong, wherein the pair of first hydraulic cylinders have first ends connected at a single attachment to one of the tongs and second ends attached at separate points to the other of the tongs such that the tongs rotate relative to each other as one of the first cylinders retracts and the other of the first cylinders extends.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
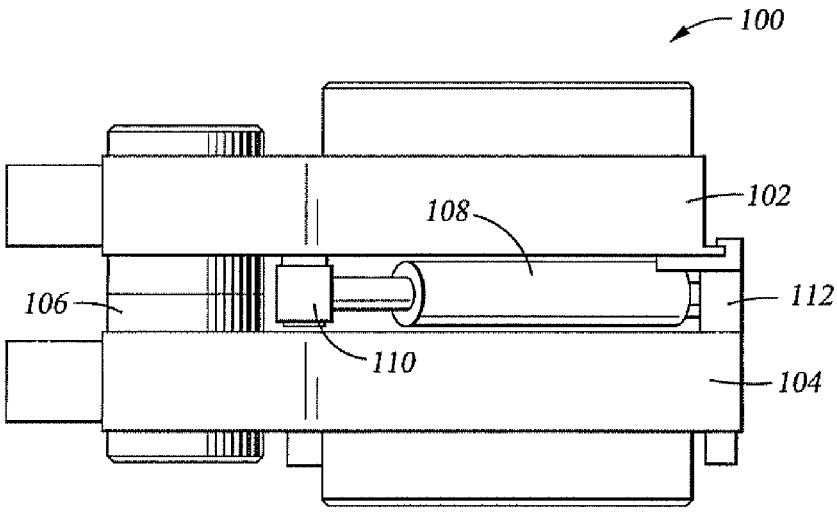
FIG. 1 is an elevation view of a tong assembly constructed in accordance with embodiments of the invention.
Figure 2:
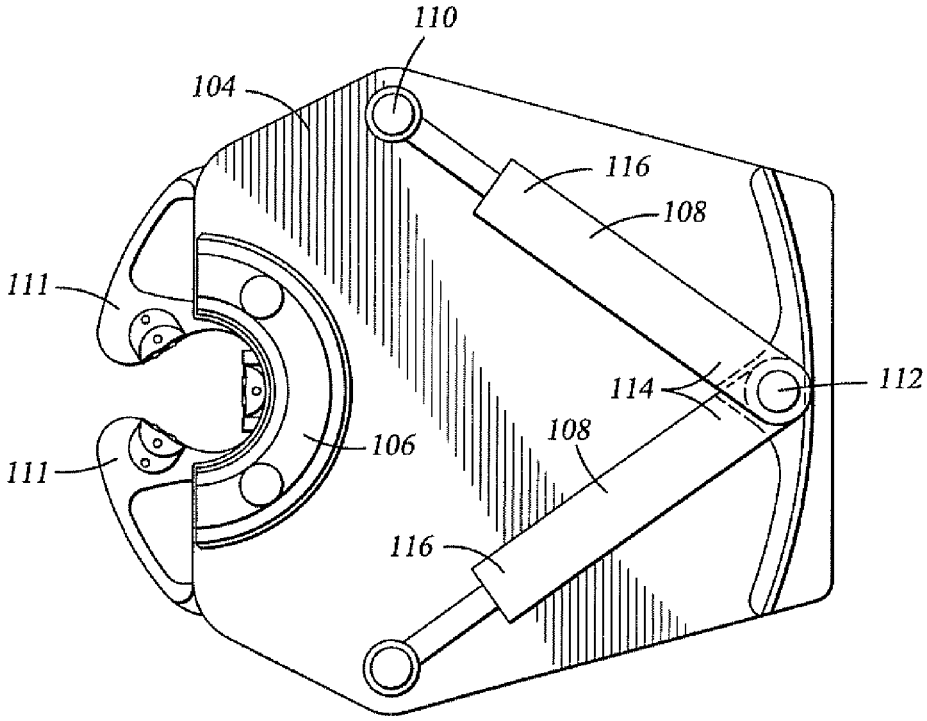
FIG. 2 is a plan view of the tong assembly of FIG. 1, with the upper tong removed.

Referring now to FIG. 1, tong assembly 100 includes top tong 102 and back-up tong 104 rotatably connected by slider 106 and torquing cylinders 108. FIG. 2 shows tong assembly 100 with top tong 102 removed. Cylinders 108 are connected to top tong 102 at pins 110 and to back-up tong 104 at pin 112. Slider 106 allows cylinders 108 to rotate top tong 102 relative to back-up tong 104 while maintaining proper alignment between the tongs.

Tong assembly 100 transfers torque produced by cylinders 108 to a threaded connection between two adjacent tubular members that are engaged by clamping arms 111. Cylinders 108 may be hydraulically linked to one another such that the piston (extend) side 114 of one cylinder is coupled to the rod (retract) side 116 of the other cylinder. In this manner, hydraulic pressure can be applied simultaneously from the same source to extend one cylinder and retract the other cylinder, thus optimizing the torque applied to the threaded connection.

Figure 3:
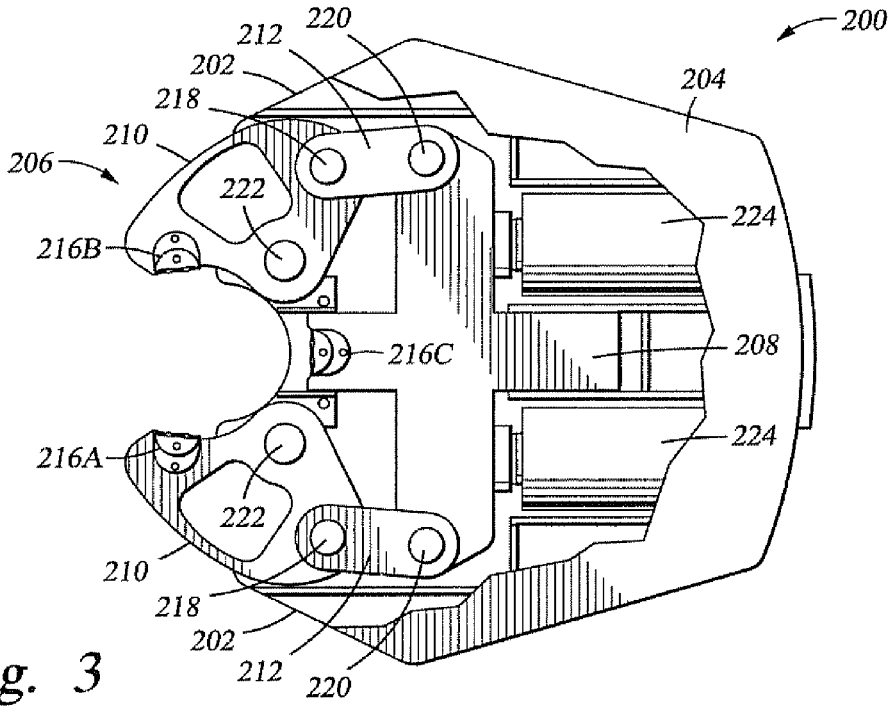
FIG. 3 is a plan view of a tong assembly in an open position.

Referring now to FIG. 3, a tong 200 is shown including body 202 with its top plate 204 partially cut away to show clamping assembly 206. Body 202 is preferably formed from a unitary weldment substantially enclosed on all but one side, which is left open to accept clamping assembly 206. Clamping assembly 206 comprises center slider 208, clamping arms 210, connecting links 212, slider guides 214, and die assemblies 216A-C. Pins 218 and 220 pivotally attach connecting links 212 to center slider 208 and clamping arms 210, respectively. Pins 222 provide a pivoting connection between clamping arms 210 and body 202. Pins 222 also carry the load that is applied by the torquing cylinders from body 202 to clamping arms 210. Clamping assembly 206 is actuated by hydraulic cylinders 224, which preferably act in unison to actuate the clamping assembly.

Figure 4:
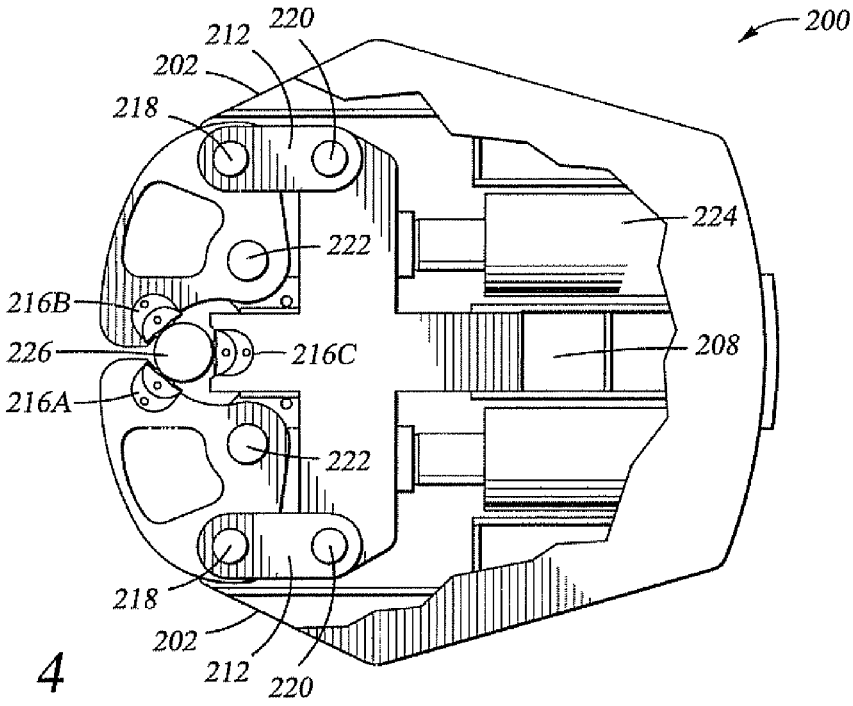
FIG. 4 is a plan view of the tong assembly of FIG. 3 in a closed position.

Referring now to FIG. 4, as hydraulic cylinders 224 extend, center slider 208 is moved toward tubular member 226. Center slider 208 pushes connecting links 212 and rotates clamping arms 210 about pins 222 until die assemblies 216A and 216B engage tubular member 226. Die assembly 216C moves toward tubular member 226 with center slider 208. Slider guides 214 maintain alignment between center slider 208 and tubular member 226 to ensure proper operation of the tong assembly. In the preferred embodiments, all three die assemblies 216A-C engage tubular member 226 at the same time and with equal amounts of force.

Figure 5:
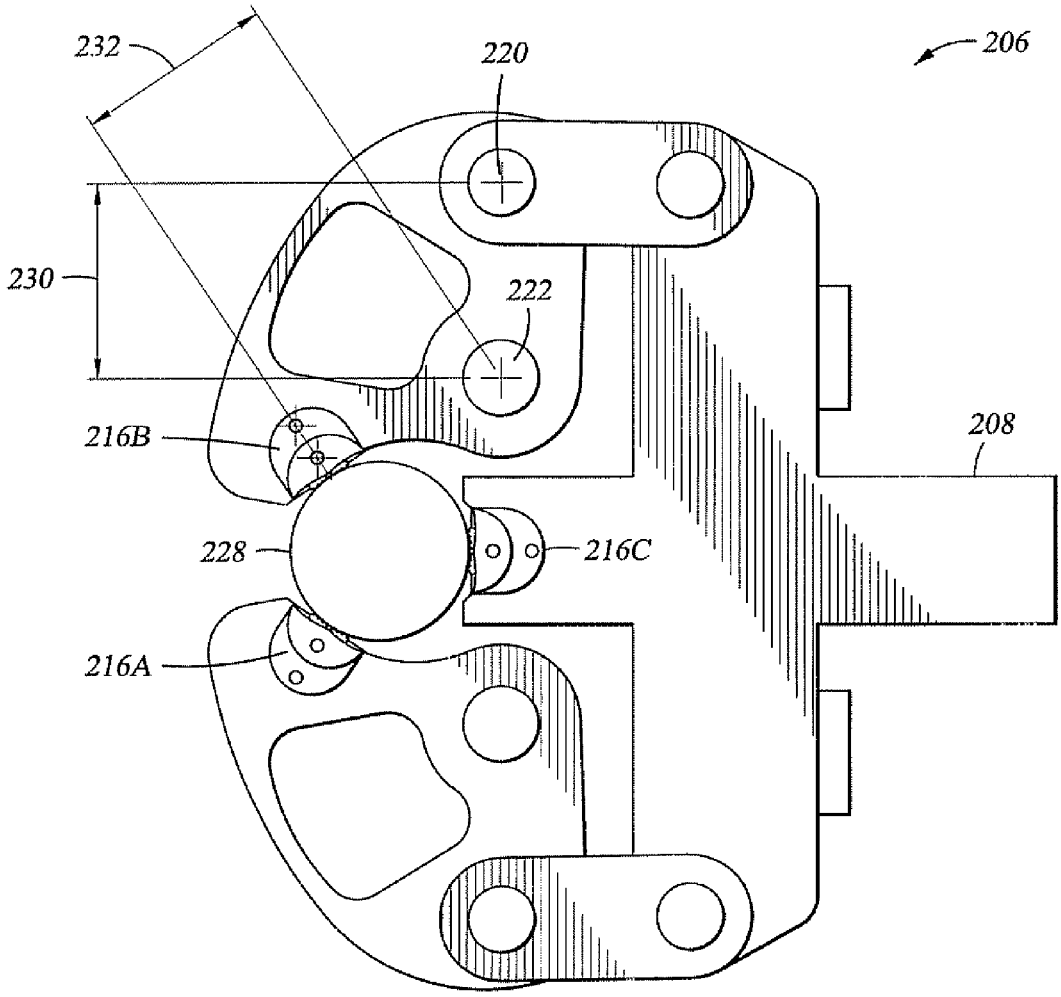
FIG. 5 is a plan view of the operating components of the tong assembly of FIGS. 3 and 4.

Referring now to FIG. 5, the actuating components of clamping assembly 206 are shown engaged with tubular member 228. In the preferred embodiments, clamping assembly 206 operates such that, within a given size range, tubular member 228 is substantially centered, and evenly engaged by die assemblies 216A-C. Therefore, clamping assembly 206 is arranged such that as die assembly 216C moves toward the center of tubular member 228, die assembles 216A and 216B also move toward the center of the tubular member at substantially the same rate.

Clamping arms 210 are arranged such that distance 232 from pin 222 to the center of die assembly 216B is substantially equal to the distance 230 from pin 222 to pin 218. Pin 218 moves in unison with, and in substantially the same direction as die assembly 216C that is mounted on center slider 208. Because pin 218 and die assembly 216B rotate about pin 222 at the substantially the same diameter, the distance traveled by die assembly 216B is substantially the same as the distance traveled by pin 218. Therefore, during actuation of clamping assembly 206, the distance traveled by die assembly 216B (or 216A) is substantially the same as the distance traveled by die assembly 216C. Because dies 216A–C have starting positions substantially the same distance from the center of tubular member 228, the tubular member will always be substantially centered by the die assemblies.

In order to accommodate a wide range of tubular sizes and ensure that tong 200 contacts the pipe surface as close to perpendicular as possible, die assemblies 216A and 216B may be rotatable relative to clamping arms 210. Die assembly 216C is preferably stationary so to not allow a tubular member to move off-center.

Figure 6:
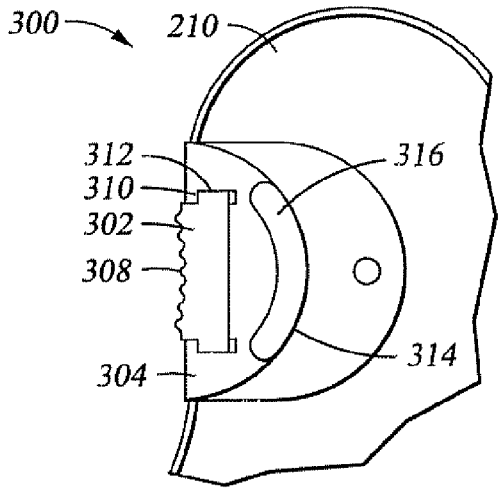
FIG. 6 is a partial plan view of one embodiment of a die assembly.

Referring now to FIG. 6, one embodiment of a die assembly 300 is shown installed in clamping arm 210 and including die 302 and holder 304. Die 302 is preferably constructed of a hardened material formed with teeth 308 for engaging the outside surface of a tubular member. Die also includes shoulders 310 configured to interface with grooves 312 in holder 304. Holder 304 has a curved rear surface 314 and curved ridge 316 on both the top and the bottom of the holder.

Figure 7:
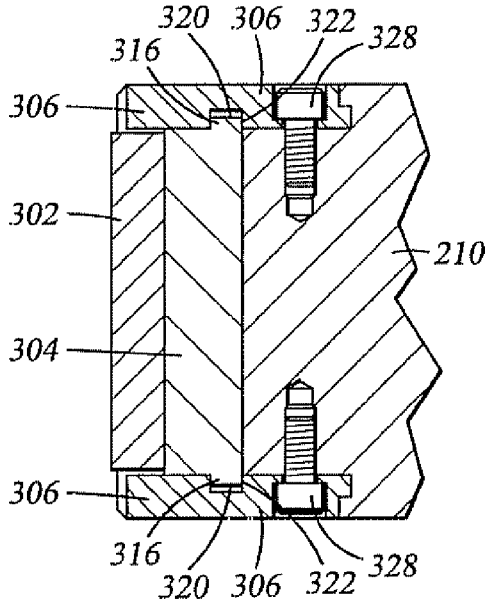
FIG. 7 is a cross-sectional elevation view of one embodiment of a die assembly.

FIG. 7 illustrates a cross-section of shows a section of a die assembly 300 assembled on a clamping arm 210. Die 302 and holder 304 are retained in position by ridges 316 interfacing with grooves 320 on retainers 306. Retainers 306 are fixed to clamping arm 210 by cap screws 328. Gaps 322 ensure that as die 302 is compressed, the load is transferred into clamping arm 210 and not into retainers 306.

Figure 8:
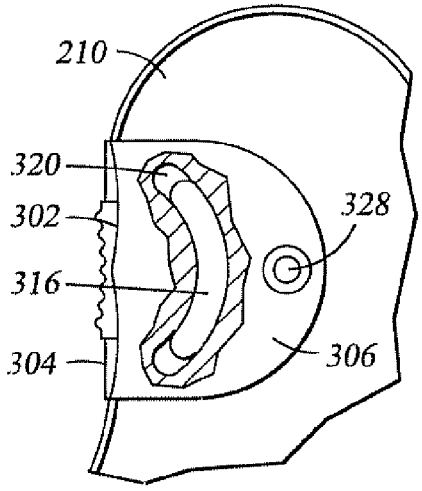
FIG. 8 is a partial sectional plan view of one embodiment of a die assembly.

Referring now to FIG. 8, a partial sectional view of die assembly 300 is shown so that the interface between ridge 316 and groove 320 can be seen. Groove 320 may be slightly longer than ridge 316 in order to allow holder 304 to rotate relative to the retainer. Each retainer 306 has a groove 320 for supporting rotation of holder 304, but the grooves on the two retainers may be different. Retainer 306 is preferably arranged so as to facilitate easy assembly and disassembly of die assembly 300 to support fast changing of die 302.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the pipe gripping and manipulating apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. A tong assembly comprising:

a body;

a center member slidable relative to said body, wherein said center member comprises a center portion disposed between two slider guides disposed on said body;

a pair of clamping arms rotatably connected to said body at a pivot connection, wherein said clamping arms are connected to said center member such that as said center member slides relative to said body, said clamping arms rotate relative to said body;

a pair of connecting links, wherein each of connecting link is pivotally coupled to said center member at first pin connection outside of the slider guides and to one of said clamping arms at a second pin connection, wherein the distance from the second pin connection to said pivot connection is equal to the distance from said pivot connection to a center of said die assembly;

a pair of actuators operable to slide said center member relative to said body, wherein one end of each actuator contacts said center member at a location between the center portion and the first pin connection; and a plurality of die assemblies, wherein at least one die assembly is mounted to each clamping arm and at least one die assembly is mounted to said center member.

2. The tong assembly of claim 1 wherein said die assemblies that are mounted to said clamping arms are rotatable relative to said clamping arms.

3. The tong assembly of claim 2 wherein the die assembly that is mounted to said center slider is not rotatable relative to said center slider.

4. The tong assembly of claim 1 wherein at least one of said die assemblies comprises:

a die;

a holder adapted to receive said die; and a retainer supporting said holder such that said holder is rotatable relative to said retainer, wherein said retainer is attached to one of said clamping arms.

5. The tong assembly of claim 1 wherein said body is a unitary weldment.

6. The tong assembly of claim 1 further comprising:

a back-up tong aligned with and adjacent to said body;

a slider connected between said body and said back-up tong, wherein said slider establishes a center point about which said body and said back-up tong can rotate; and a pair of hydraulic cylinders operable to rotate said body relative to said back-up tong, wherein said pair of first hydraulic cylinders have first ends connected at a single attachment to said body and second ends attached at separate points to said back-up tong such that the tong and the body rotate relative to each other as one of said first cylinders retracts and the other of said first cylinders extends.

* * * * *